US006012605A

United States Patent [19]

Miloscia

[11] Patent Number: 6,012,605

[45] Date of Patent: Jan. 11, 2000

[54] VERTICAL ROLL PRODUCT DISPENSER

[76] Inventor: Craig Miloscia, 2088 Murray Hill Rd. Suite 5, Cleveland, Ohio 44106

[21] Appl. No.: 09/044,600

[22] Filed: Mar. 19, 1998

Related U.S. Application Data

[60] Provisional application No. 60/041,059, Mar. 20, 1997.

[51] Int. Cl.[7] ..... B65G 59/00

[52] U.S. Cl. ..... 221/282; 242/588

[58] Field of Search ..... 221/33, 45, 68, 221/282; 242/586, 586.6, 586.4, 597.7, 588, 596, 596.5, 596.1

[56] References Cited

U.S. PATENT DOCUMENTS 5,605,304 2/1997 Ahern, Jr. ..... 242/588

FOREIGN PATENT DOCUMENTS 1016068 1/1966 United Kingdom ..... 242/596.3

*Primary Examiner*—Kenneth W. Noland

*Attorney, Agent, or Firm*—Oldham & Oldham Co., LPA

[57] ABSTRACT

A vertical roll product dispenser provides an aesthetically pleasing and functionally efficient device for receiving a web of material wound on a central core and retaining the ends of the core between a pair of vertically aligned spheres so that the roll product may be dispensed while the dispensing device rests on a horizontal surface.

13 Claims, 2 Drawing Sheets

VERTICAL ROLL PRODUCT DISPENSER

This is a provisional application of No. 60/041,059, filed on 03/20/1997.

The present invention relates to a device for dispensing products contained on a roll, such as paper towels, toilet paper and the like. More particularly, the present invention relates to a device which orients the roll of product to be dispensed in a vertical manner and dispenses the products. In this manner, the device may be placed on a horizontal surface for use.

BACKGROUND OF THE ART

Several products commonly used in the household are purchased wound in a roll on a core, typically a cardboard type of core. Products like this include paper towels, toilet paper, disposable plastic bags and other transversely perforated products, as well as some roll products which are not transversely perforated, such as wax paper and plastic wrapping film. While these products are often placed in a dispenser or hung from a surface so that the axis of the central core is horizontally oriented, in some circumstances it is both functionally required and/or aesthetically pleasing to have the product available in a vertical orientation of the core axis, particularly with one end of the dispenser resting on a horizontal surface, such as a kitchen counter.

SUMMARY OF THE INVENTION

It is, therefore, an object of the present invention to provide an aesthetically pleasing and functionally efficient device for receiving a roll of product wound on a central core, to retain the product in a vertical orientation and to make the product readily available to a user. This object is achieved by a device for dispensing a web of material from a vertically disposed core. The device comprises a base, an arm with a first sphere mounted at an end thereof and a second sphere. The base has a central aperture on an upper surface, the second sphere being seated rotatably in the central aperture. The an arm has its first end mounted in the base and extending vertically upward from a peripheral edge of the upper surface. The arm also has a n elbow formed near the second end so that the first sphere is vertically aligned with the central aperture.

BRIEF DESCRIPTION OF THE DRAWINGS

Better understanding of the present invention will be had when reference is made to the accompanying drawings, wherein identical parts are identified with identical part numbers and wherein.

DETAILED DESCRIPTION OF THE INVENTION

Figure 1:
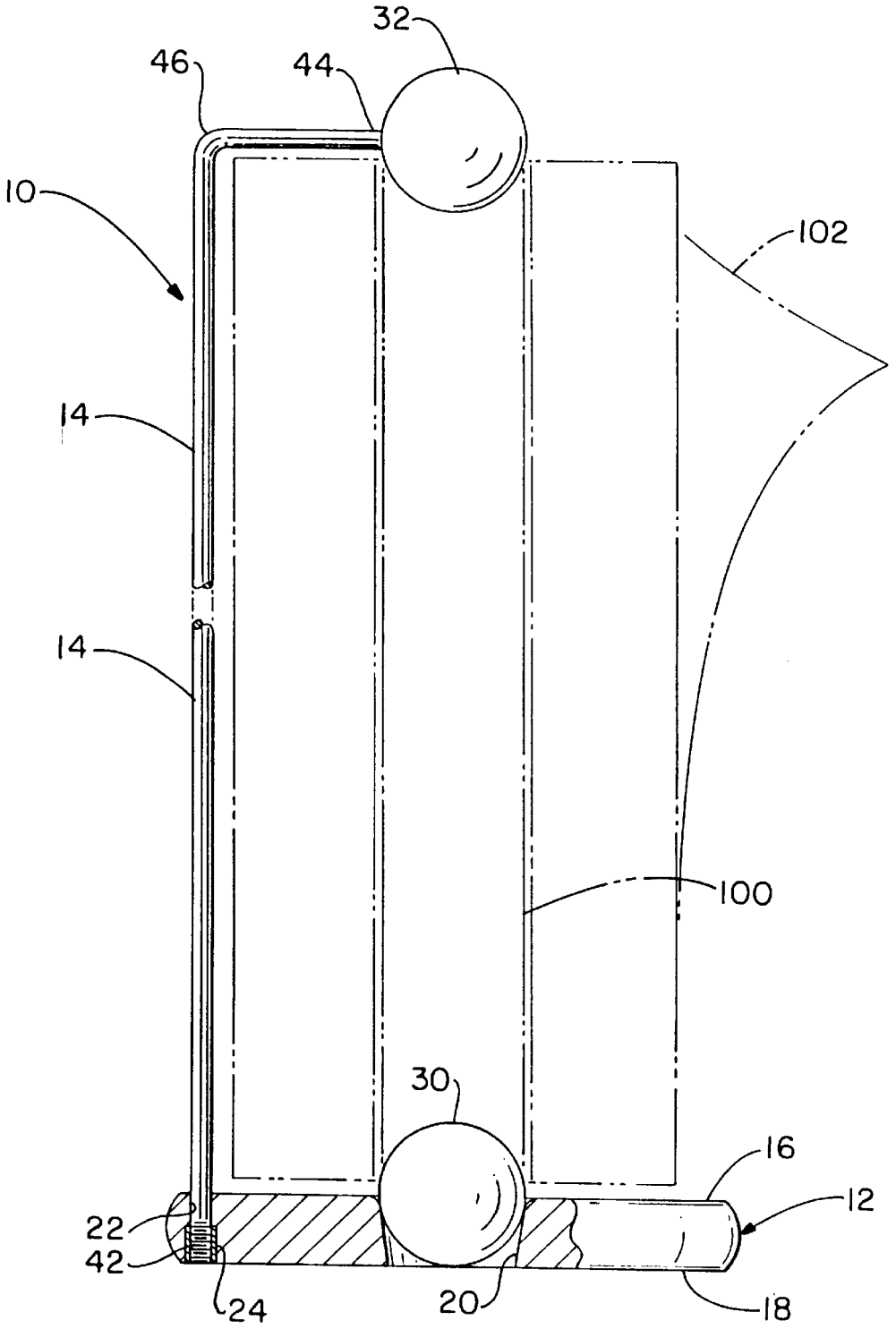
FIG. 1 is a side elevational view with portions broken away and shown in section of the device of the present invention.

The roll product dispenser 10 of the present invention is shown in side elevational view in FIG. 1, which also shows in phantom lining a core 100 having a web 102 of a dispensable product wound thereupon. The dispenser 10 comprises a base 12, and an arm 14 extending from near a peripheral edge of the base. The arm 14 extends vertically upwardly, essentially normal to an upper surface 16 of the base 12. The base 12 is preferably round with a diameter larger than the maximum diameter of the product roll to be dispensed thereupon. In addition to the upper surface 16, the base 12 has a lower surface 18, both surfaces 16, 18 being preferably flat and parallel to each other so that the overall appearance of the base is that of a disk. A central aperture 20 is formed in the base 12, having a diameter which increases generally from the lower surface 18 at which it is the smallest to the upper surface 16 at which it is the largest. An aperture 22 placed near the peripheral edge of the base 12 and passing through the base in an axial direction between the upper and lower surfaces 16, 18 is used to receive an end of the arm 14. As will be explained further below, this aperture 22 may be counter-bored at the end terminating at the lower surface 18 for receiving a threading piece 24. The base 12 is preferably comprised of wood, but other materials including metals and polymeric materials may be utilized and the selection of the exact material will be largely due to the aesthetic features of the product.

Seatable in the central aperture 20 at the top surface 16 of the base 12 is a sphere 30, typically of the same material as the base, although not necessarily. The sphere 30 is sized to allow the sphere to sit atop the central aperture 20 on the top surface 16 and remain freely rotatable therein. For this reason, the base 12 will be thick enough relative to the diameter of the sphere 30 that no portion of the sphere protrudes from the lower surface opening of the central aperture 20 when the sphere is seated therein on the top surface. Most particularly, the sphere 30 is sized with a diameter which is slightly larger than the diameter of the core 100 which will be seated upon the sphere.

The arm 14 of the dispenser 10 is shown in FIG. 1 as having an indeterminate length, but the specific length will be carefully selected for the specific type of core 100 and web 102 of product to be received. For example, in the United States a roll of paper towels nominally has a core length of 11 inches and a diameter of (on a full roll) of about 6 inches, the core 100 having an internal diameter of about 1.5 inches. A typical roll of toilet paper has a similar 1.5 inch internal diameter for the core, although the length of the core is more usually about 4.5 inches and the outside diameter of a full roll is about 4.5 inches. The arm 14 has a first end 42 which is secured in the base 12 as described further below and a second end 44. Between the ends, but nearer the second end 44, an elbow 46 is formed in the arm. A sphere 32 substantially identical in size to sphere 30 is mounted on the second end 44 such that the two spheres are axially aligned. Because the arm 14 is preferably formed from an inherently flexible material such as metal, the upper or second end 44 of the arm may be moved slightly so that a roll of product may be inserted with the ends of the core 100 being held between the two spheres 30, 32, as shown in FIG. 1.

Figures 2, 3, 4:
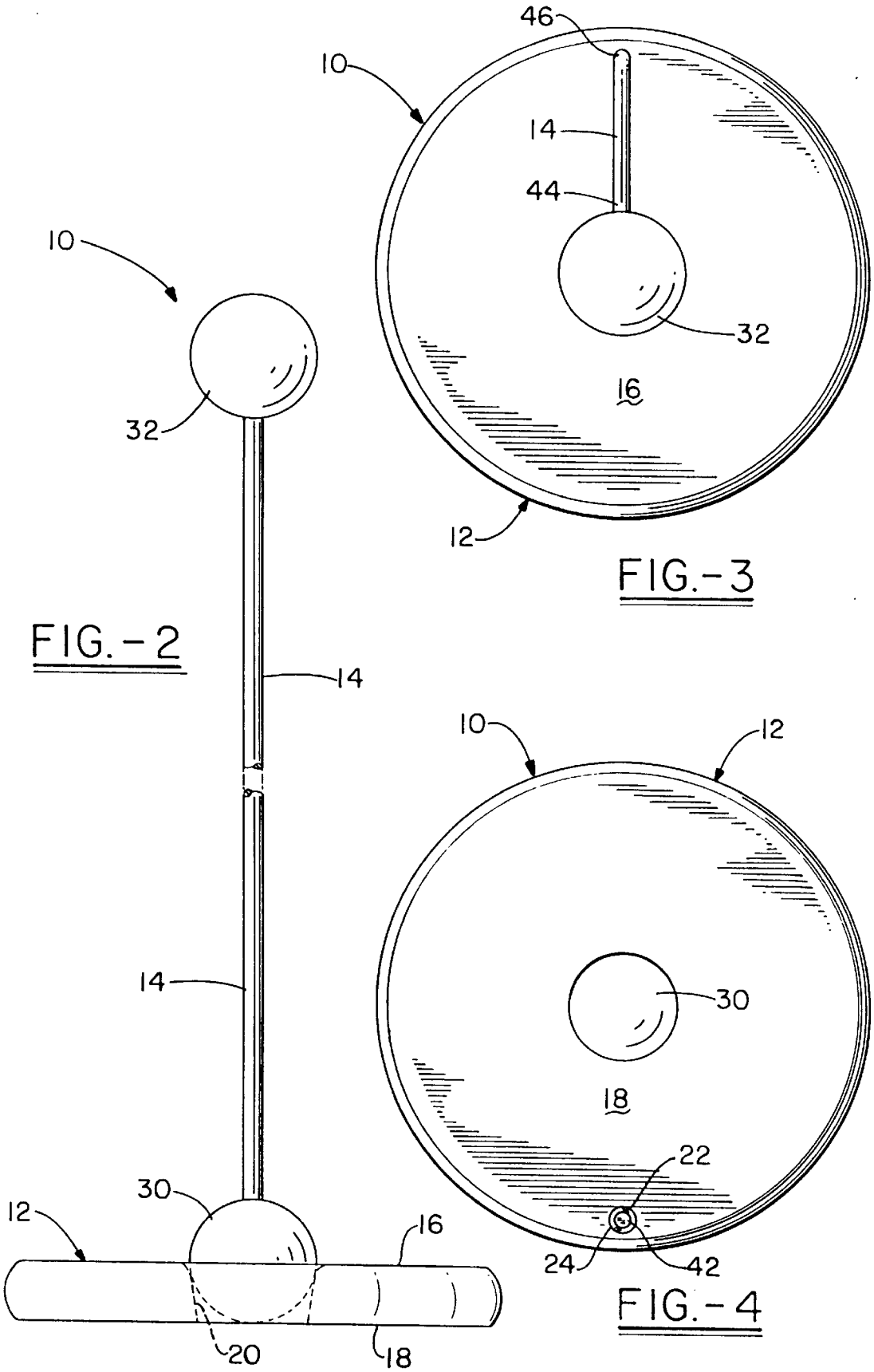
FIG. 2 is a front elevational view.
FIG. 3 is a top view.
FIG. 4 is a bottom view.

FIG. 2 shows the dispenser 10 of the present invention from a front elevation view without the paper roll in place. FIGS. 3 and 4 show the dispenser in top and bottom view, respectively, without the paper roll in place. Directing attention to FIG. 4, it will be noted that there is a threading piece 24, preferably a metallic element having internal threading, placed in the counter-bored aperture 22 so that when the 12 arm is inserted into the aperture from the upper surface side, the first end 42 of the arm may have a section of external threading formed thereupon received by the internal threading in the threading piece. In this manner, the arm 14 is received into the base 12 and is securely held in vertical extension from the base with the spheres 30, 32 in axial alignment.

In an embodiment of this dispenser intended to be used for dispensing paper towels coming from a typical paper towel roll, the base will be approximately 7 inches in diameter and approximately 0.875 inches thick. The spheres 30, 32 used at each end of the core will have a diameter of approximately 1.75 inches. The arm 14 will comprise a metallic member with a diameter of about 0.25 inches and a length sufficient to position the center of the second sphere 32 approximately 12.875 inches above the lower surface of the base. The central aperture 20 of the base 12 will have a diameter along the bottom surface 18 of approximately 1.5 inches and a diameter at the top surface 16 slightly in excess of 2 inches. The arm 14 is preferably comprised of low carbon steel wire and the elbow bend 46 interposed near the second end 44 should have a radius of curvature of approximately 0.375.

While the preferred embodiment of the invention has been disclosed, the scope of the invention is not to be measured thereby, but is instead to be determined from the allowed claims.

What is claimed is:

1. A device for dispensing a web of material from a vertically disposed core, comprising:

a base with a central aperture on an upper surface thereof;

an arm having a first end extending vertically upward from a peripheral edge of the upper surface and having a second end with a elbow formed in the arm near the second end and a first sphere mounted on the second end; and a second sphere seated rotatably in the central aperture.

2. The device of claim 1 wherein the first and second spheres are identical in diameter.

3. The device of claim 2 wherein the first and second spheres have a diameter larger than the diameter of the core.

4. The device of claim 1 wherein the first sphere is vertically aligned with the central aperture.

5. The device of claim 1 wherein the arm is formed from a flexible material such as metal.

6. The device of claim 1 wherein the arm is long enough that the web may be vertically mounted in a frictional fit between the first and second spheres when the second sphere is seated in the central aperture.

7. The device of claim 1 wherein the central aperture has a diameter at the upper surface of the base which is smaller than the diameter of the second sphere.

8. The device of claim 1 wherein the base has a thickness that is less than the diameter of the second sphere.

9. The device of claim 1 wherein the central aperture is sized such that the second sphere is freely rotatable therein.

10. The device of claim 1 wherein the arm is formed of low carbon steel.

11. The device of claim 1 wherein the first and second spheres are formed of wood.

12. The device of claim 11 wherein the base is formed of wood.

13. The device of claim 1 wherein the first end of the arm is threadingly received into a bore in the upper surface of the base.

* * * * *